US006761508B1

(12) United States Patent
Haun

(10) Patent No.: US 6,761,508 B1
(45) Date of Patent: Jul. 13, 2004

(54) SATELLITE SEPARATOR PLATFORM(SSP)

(75) Inventor: Richard David Haun, Katy, TX (US)

(73) Assignee: Ope, Inc., Houston, TX (US)

( * ) Notice: Subject to any disclaimer, the term of this patent is extended or adjusted under 35 U.S.C. 154(b) by 0 days.

(21) Appl. No.: 09/980,844

(22) PCT Filed: Apr. 20, 2000

(86) PCT No.: PCT/US00/10936

§ 371 (c)(1),
(2), (4) Date: Oct. 22, 2001

(87) PCT Pub. No.: WO00/63519

PCT Pub. Date: Oct. 26, 2000

Related U.S. Application Data

(60) Provisional application No. 60/130,443, filed on Apr. 21, 1999.

(51) Int. Cl.[7] ..... B63B 35/44

(52) U.S. Cl. ..... 405/224; 405/205; 114/264

(58) Field of Search ..... 405/195.1, 196, 405/200, 204, 205, 207, 208, 223.1, 224, 224.3; 114/264, 265

(56) References Cited

U.S. PATENT DOCUMENTS

| | | | | |
|---|---|---|---|---|
| 3,224,401 A | * 12/1965 | Kobus | 114/265 |
| 3,635,182 A | 1/1972 | Paffett | 114/0.5 |
| 3,673,975 A | 7/1972 | Strauss | 114/43.5 |
| 3,739,737 A | 6/1973 | Baier | 114/0.5 D |
| 3,788,254 A | 1/1974 | Sheil | 114/0.5 F |
| 3,870,010 A | 3/1975 | Wright | 114/230 |
| 3,885,511 A | 5/1975 | Wipkink et al. | 114/0.5 D |
| 3,949,693 A | 4/1976 | Bauer et al. | 114/0.5 D |
| 3,951,085 A | 4/1976 | Johnson et al. | 114/0.5 F |
| 3,951,086 A | 4/1976 | Lown et al. | 114/0.5 D |
| 3,975,784 A | 8/1976 | Whitaker | 9/8 R |
| 3,978,805 A | 9/1976 | Thomas | 114/0.5 F |

(List continued on next page.)

FOREIGN PATENT DOCUMENTS

| | | | |
|---|---|---|---|
| GB | 2150516 A | 7/1985 | B63B/39/00 |

*Primary Examiner*—Thomas B. Will
*Assistant Examiner*—Tara L. Mayo
(74) *Attorney, Agent, or Firm*—Madan, Mossman & Sriram, P.C.

(57) ABSTRACT

A floating platform with motion characteristics for offshore deepwater developments with vertical axial symmetry and decoupling of hydrodynamic design features. A motion-damping skirt (120) is provided around the base of the hull (1), which is configured to provide ease of installation for various umbilicals and risers. A retractable center assembly (300) is used in a lowered position to adjust the center of gravity and metacentric height, reducing wind loads and moments on the structure, providing lateral areas for damping and volume for added mass for roll resistance. The center assembly (300) is used to tune system response in conjunction with the hull damping skirt (120) and fins (121). The center assembly (300) also includes separators (350) below the floating platform deck which serve to add stability to the floating structure by shifting the center of gravity downward, the separators (350) capable of being raised and lowered vertical separators alone or as a unit.

23 Claims, 8 Drawing Sheets

U.S. PATENT DOCUMENTS

| | | | | | |
|---|---|---|---|---|---|
| 3,982,492 | A | | 9/1976 | Steddum | 114/0.5 D |
| 4,067,285 | A | | 1/1978 | Jones et al. | 114/266 |
| 4,087,984 | A | | 5/1978 | Mo | 61/94 |
| 4,108,102 | A | | 8/1978 | Linstrom | 114/264 |
| 4,117,691 | A | * | 10/1978 | Spray | 405/205 |
| 4,155,323 | A | | 5/1979 | Finsterwalder | 114/264 |
| 4,155,673 | A | | 5/1979 | Yashima | 405/224 |
| 4,155,674 | A | | 5/1979 | Martin | 405/224 |
| 4,167,147 | A | | 9/1979 | Bergman | 114/122 |
| 4,168,556 | A | | 9/1979 | Fink et al. | 9/8 R |
| 4,168,673 | A | | 9/1979 | Poeppel | 114/265 |
| 4,170,186 | A | | 10/1979 | Shaw | 114/264 |
| 4,217,848 | A | | 8/1980 | Mayer-Haake | 114/264 |
| 4,239,417 | A | | 12/1980 | Slatten et al. | 405/195 |
| 4,281,613 | A | | 8/1981 | Ray et al. | 114/230 |
| 4,286,538 | A | | 9/1981 | Matsui | 114/266 |
| 4,310,052 | A | | 1/1982 | Rivertz | 166/362 |
| 4,378,178 | A | | 3/1983 | Roach | 405/224 |
| 4,406,243 | A | | 9/1983 | Kim | 114/264 |
| 4,409,921 | A | | 10/1983 | Carroll et al. | 114/264 |
| 4,433,941 | A | | 2/1984 | Gerwick, Jr. et al. | 405/211 |
| 4,452,165 | A | | 6/1984 | Bergman | 114/125 |
| 4,457,250 | A | | 7/1984 | Oshima et al. | 114/265 |
| 4,481,899 | A | | 11/1984 | Einstabland et al. | 114/264 |
| 4,482,274 | A | | 11/1984 | Brandi et al. | 405/224 |
| 4,498,412 | A | | 2/1985 | Liden | 114/264 |
| 4,519,728 | A | | 5/1985 | Oshima et al. | 405/224 |
| 4,554,883 | A | | 11/1985 | Lane | 114/266 |
| 4,565,150 | A | | 1/1986 | Liden | 114/265 |
| 4,576,517 | A | | 3/1986 | McCann et al. | 405/195 |
| 4,576,520 | A | | 3/1986 | Suh et al. | 405/224 |
| RE32,119 | E | | 4/1986 | Abbott et al. | 405/227 |
| 4,596,291 | A | | 6/1986 | Makinen et al. | 175/5 |
| 4,604,962 | A | | 8/1986 | Guibault | 114/266 |
| 4,606,673 | A | | 8/1986 | Daniell | 405/210 |
| 4,626,137 | A | | 12/1986 | Willemsz | 405/224 |
| 4,653,960 | A | | 3/1987 | Chun | 405/210 |
| 4,666,341 | A | * | 5/1987 | Field et al. | 405/217 |
| 4,674,919 | A | | 6/1987 | Olsen et al. | 405/226 |
| 4,685,833 | A | | 8/1987 | Iwamoto | 405/195 |
| 4,692,065 | A | | 9/1987 | Suzuki et al. | 405/211 |
| 4,716,972 | A | | 1/1988 | Makinen et al. | 175/8 |
| 4,746,245 | A | | 5/1988 | Mork | 405/224 |
| 4,834,014 | A | | 5/1989 | Olsen et al. | 114/265 |
| 4,886,398 | A | | 12/1989 | Sparks | 405/224 |
| 4,906,139 | A | | 3/1990 | Chiu et al. | 405/196 |
| 4,913,591 | A | | 4/1990 | Steele | 405/196 |
| 4,987,846 | A | | 1/1991 | Yamashita et al. | 114/265 |
| 5,129,347 | A | | 7/1992 | Hill | 114/266 |
| 5,213,447 | A | | 5/1993 | Srock | 405/219 |
| 5,215,028 | A | | 6/1993 | Hayakawa | 114/267 |
| 5,363,788 | A | | 11/1994 | Delreiu | 114/125 |
| 5,375,550 | A | | 12/1994 | Innis | 114/267 |
| 5,525,011 | A | | 6/1996 | Huang | 405/223.1 |
| 5,536,117 | A | | 7/1996 | Frame et al. | 405/202 |
| 5,588,387 | A | | 12/1996 | Tellington | 114/261 |
| 5,609,442 | A | | 3/1997 | Horton | 405/205 |
| 5,704,731 | A | | 1/1998 | Huang | 405/223.1 |
| 5,722,797 | A | | 3/1998 | Horton, III | 405/224 |
| 6,102,625 | A | * | 8/2000 | Olsen et al. | 405/195.1 |

* cited by examiner

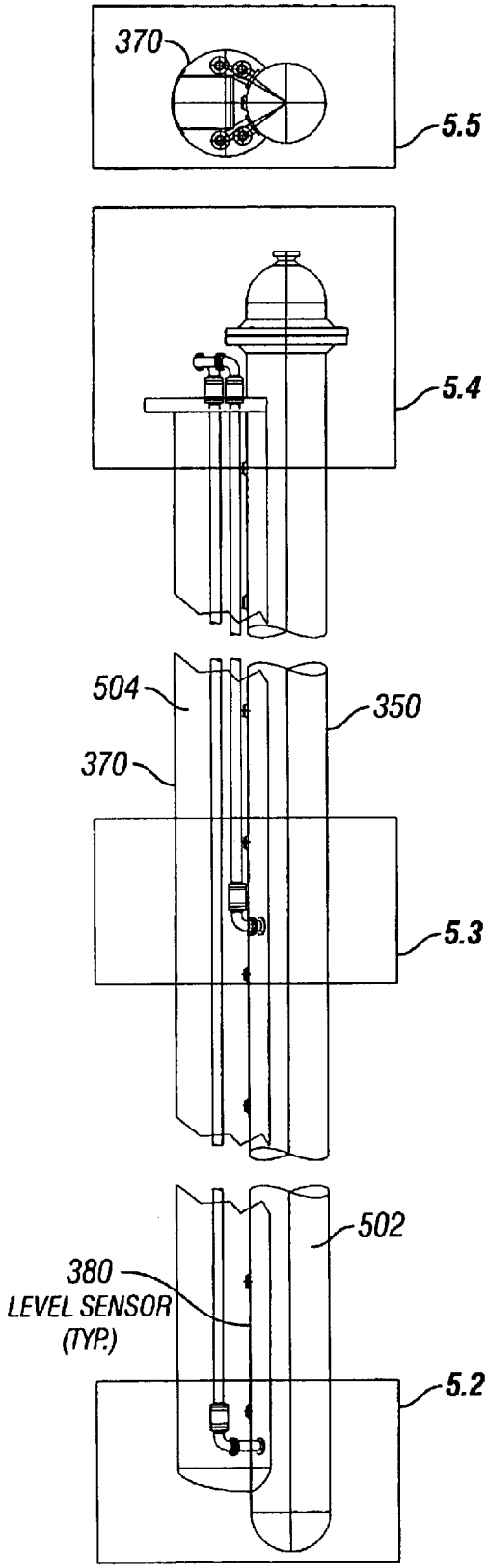
FIG. 5.1A
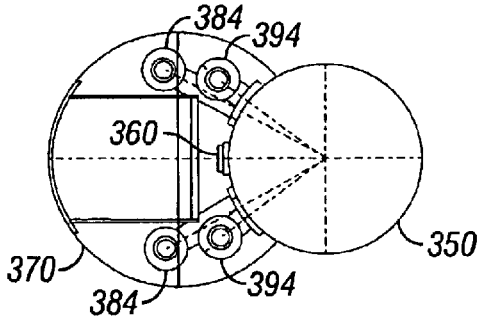
FIG. 5.5

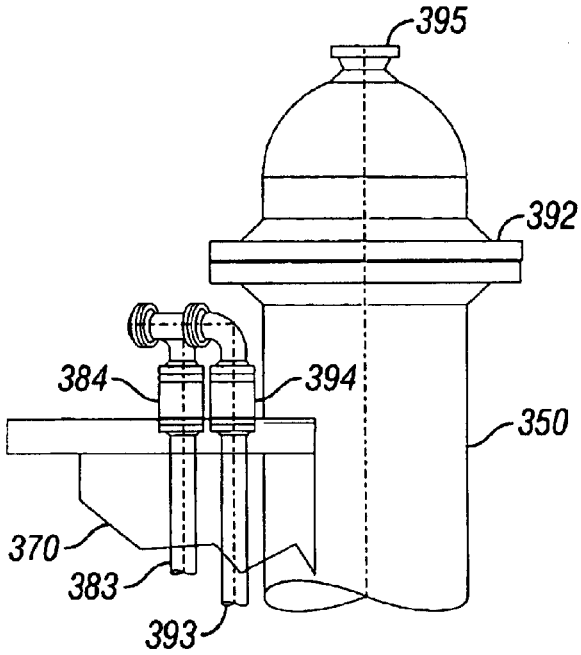
FIG. 5.4
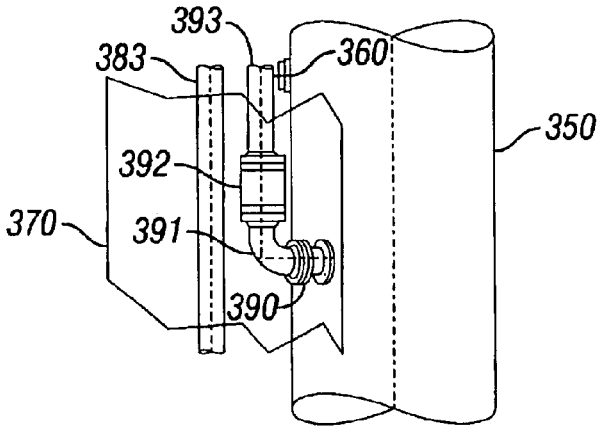
FIG. 5.3
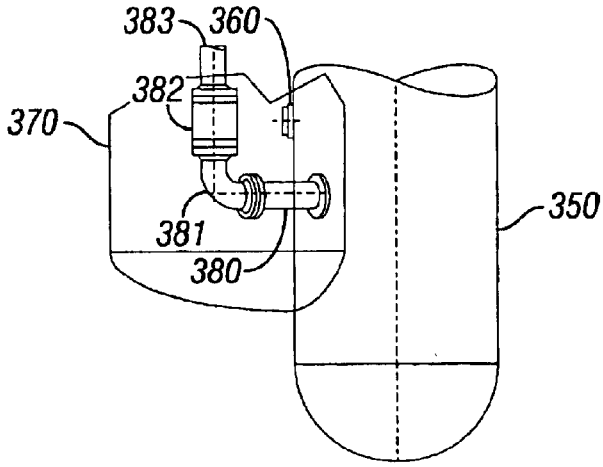
FIG. 5.2

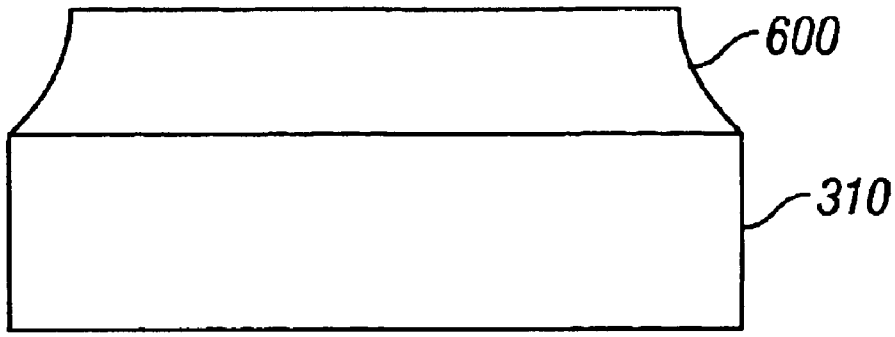
FIG. 5.6
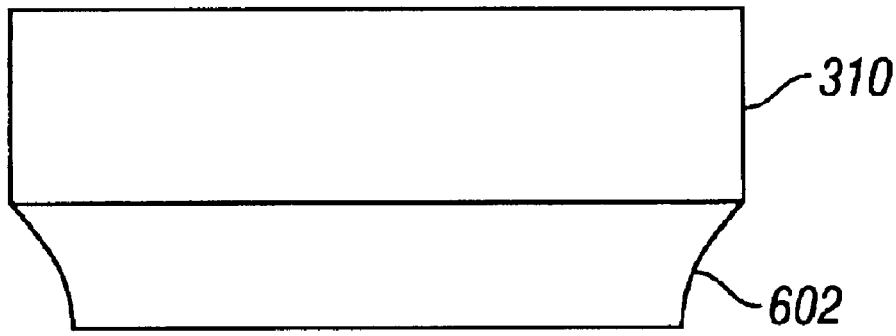
FIG. 5.7

SATELLITE SEPARATOR PLATFORM(SSP)

This application is a 371 of PCT/US00/10936 Apr. 20, 2000 which claims the benefit of provisional application Ser. No. 60/130,443, filed Apr. 21, 1999, entitled, Satellite Separator Platform (SSP).

SPECIFICATION FIELD OF THE INVENTION

The invention relates to a moored offshore or self-propelled floating platform with improved motion characteristics for economic offshore deepwater developments. The floating platform of the present invention is capable of being self propelled in mild environments or moored for use in extreme depths and severe wind and wave conditions.

BACKGROUND

In the development of offshore energy systems such as deepwater oil and/or gas production, long flowlines, power cables and control umbilicals are frequently required between subsea wells and a host platform. The extended lengths pose energy loss, pressure drop and production difficulties.

Costs of structures for deepwater applications are high and costs are frequently increased due to the foreign locations at which they are fabricated. Other difficulties, associated with deepwater offshore operations, result from floating vessel motions which affect personnel and efficiencies especially when related to liquid dynamics in tanks. The primary motion related problem, associated with offshore petrochemical operations, occurs with large horizontal vessels in which the liquid level oscillates and provides erroneous signals to the liquid level instruments causing shutdown of processing and overall inefficiency for the operation.

Prior art for deepwater has generally resulted in facilities that yield expensive solutions for an offshore oil field development. Such prior art includes tension leg platforms (TLP's), which may incorporate well drilling capabilities to several mini-TLP designs that perform simplified functions; SPARS which are configured much the same as a spar buoy and have dry wellheads, as opposed to subsea trees; deepwater floating production storage facilities (FPSO's) and their several variations.

Present tendon technology limits the common TLPs to approximately 5,000-ft water depths, which causes them to be stationed long distances from planned deepwater fields and the subsea wells. Systems that are moored by catenary lines can be placed within the deepwater fields within fairly close proximity to the subsea wells.

The principal elements which can be modified for improving the motion characteristics of a moored floating vessel are the draft, the water plane area and its draft rate of change, location of the center of gravity (CG), the metacentric height about which small amplitude roll and pitching motions occur, the frontal area and shape on which winds, current and waves act, the system response of pipe and cables contacting the seabed acting as mooring elements, and the hydrodynamic parameters of added mass and damping. The latter values are determined by complex solutions of the potential flow equations integrated over the floating vessel's detailed features and appendages and then simultaneously solved for the potential source strengths. It is only significant to note herein that the addition of features which allow the added mass and/or damping to be 'tuned' for a certain condition requires that several features can be modified in combination, or more preferably independently, to provide the desired properties. The optimization is greatly simplified if the vessel possesses vertical axial symmetry as in the present invention which reduces the 6 degrees of motion freedom to 4, (i.e., roll=pitch=pendular motion, sway=surge=lateral motion, yaw=rotational motion, and heave=vertical motion). It is further simplified if hydrodynamic design features may be de-coupled to linearize the process and ease the ideal solution search.

An object of the present invention is a floating platform which contains features which allow the platform motions to be optimized for size and weight to specified hydrodynamic environments and to include features which reduce offshore oil and gas processing operations and field development costs.

A further object of the present invention is to provide a platform which allows the roll hydrodynamics to be determined and optimized and by other features allows tuning of the frequency response for the vertical heave.

An additional object of the present invention is a more efficient self propelled or severe weather moored deepwater floating platform called an SSP with focus upon providing improved vessel motions in wind and wave conditions while exhibiting features which reduce offshore gas/oil field development and operation costs.

SUMMARY OF THE INVENTION

The present invention provides for an offshore floating facility with improved hydrodynamic characteristics and the ability to moor in extended depths thereby providing a satellite platform in deep water resulting in shorter flowlines, cables and umbilicals from the subsea trees to the platform facilities. The design incorporates a retractable center assembly which contains features to enhance the hydrodynamics and allows for the integral use of vertical separators in a quantity and size providing opportunity for individual full time well flow monitoring and extended retention times.

The floating platform of the present invention is capable of being self-propelled in mild environments or moored for use in extreme depths and sever wind and wave conditions. The floating platform may be configured to perform the functions of a well-gathering platform, an offshore utility work platform; a remote power or communication transmission hub or relay platform or a satellite separator platform (SSP). The floating platform is hereafter referred to as an SSP despite its adapted use.

A principal feature of the SSP is a retractable center assembly within the hull, which may be raised or lowered in the field to allow transit in shallow areas. The retractable center assembly provides a means of pitch motion damping, a large volumetric space for the incorporation of optional ballast, storage, vertical pressure or storage vessels, or a centrally located moon pool for deploying diving or remote operated vehicle (ROV) video operations without the need for added support vessels.

Hydrodynamic motion improvements are provided by: the basic hull configuration; extended skirt and radial fins at the hull base; a (lowered at site) center assembly extending the retractable center section with base and mid-mounted hydrodynamic skirts and fins, the mass of the separators below the hull deck of the SSP favorably lowering the center of gravity; and attachment of the steel catenary risers, cables, umbilicals and mooring lines near the center of gravity at the hull base. The noted features improve vessel stability and provide increased added mass and damping which improves the overall response of the system under environmental loading.

Key field production items that are satisfied by the invention are: housing large and efficient vertical high-pressure separators with extended retention times which can minimize multiphase flow with upstream primary separation closer to subsea wells which also improves reservoir recovery ratios, providing vertical separators of such dimension that multiple sensors can be used to optimize the liquid gas interface level; providing more economical full pigging ability with individual control of well flowlines; providing individual well flowline chemical injection without added subsea manifolding; simplification of operations and maintenance requirements; and providing for reduced inspection costs below water by the incorporation of a moon pool on the SSP centerline.

The principal cost reductions evolve from: the ability to perform fabrication in relatively shallow water sites; elimination of the necessity of costly offshore deck installation which is typical of certain deepwater alternatives; allowing for short transportation routes to the offshore field by minimizing draft and allowing use of domestic coastal fabrication facilities; providing duplicate functions for structural appendages to minimize fabricated weight and maximize the available flotation per ton of fabrication; and providing pressure control as close to the field as practical for improved economics of pipeline and flowline steel tonnage and installation cost reduction.

The prior art does not disclose methods for: the use of retractable center sections which by their position, structure, appendages, and contents improve the in-place hydrodynamic characteristics while allowing shallow water access when fully raised. The prior art also does not disclose methods of providing increased extended duration vertical vessels or separators below the floating platform deck that serve to add stability of the floating structure by favorably shifting the center of gravity downward while also increasing the roll and heave-added mass and damping of the floating structure for reduced platform motions in wind and waves. The prior art also does not disclose methods of raising and lowering vertical separators alone or as a unit within a center assembly to allow passage to or from shallow waters. The prior art does not disclose methods of providing a one-atmosphere access zone around the operational components of separators suspended from a floating platform. The prior art does not disclose methods of optimizing a vertical separator's performance by a nearly continuous array of sensors that allow a variable liquid level. The prior art does not disclose extending a skirt at the base of a hull with a diameter and configuration to ease the offshore attachment of steel catenary risers, umbilicals, and cables.

Because of the features which may be provided for, when utilized in the capacity of a floating deepwater oil and/or gas primary separation platform, the SSP performs bulk separation and yields full time test capabilities of each attached well via the flowlines and well control umbilicals. The hull features of the SSP include objects of the invention such as the vertical columns which provide hull-stiffening while serving as mooring line conduits for above water mooring line tensioning, and tension monitoring; facilities for the installation I addition/maintenance of the long vertical separators offshore; benefits afforded by the hydrodynamic hull damping skirt that doubles as a submerged towing rim and a load ring that distributes the transverse mooring loads and provides a foundation for steel catenary risers; umbilicals and cables; the separator supported damping skirt which doubles as separator spacing restraints; and the separator raising and lowering frame systems allowing shallow water fabrication yard access.

Due to the size of the individual first stage vertical separators and slug catchers afforded by the center assembly space and the available extended residence times which can be accommodated, efficient high-pressure separation can be accomplished for the purposes of minimizing transportation of produced reservoir water over long distances. Vertical, as opposed to horizontal, separators minimize motion effects due to the reduced overall elevation significance of internal separator fluid waves without the need for baffles and utilize the nearly unlimited available space within the water column without wasting deck space.

Other functions provided by the SSP, while in the role of an oil/gas platform, are pigging of the flowlines and outgoing gas/oil lines; metering of multiple wells; chemical injection of the incoming and outgoing lines; manifolding to perform the required functions; quarters facilities for the limited crew required for operations; instrument gas generation and controls; satellite and other information transmissions to the host platform(s); electric power transmission; and umbilical control of the satellite wells.

While Individual prior art includes several of the above features, none have addressed the aspect of extended oil/gas separation residence times in vertical separators and variable elevations control of the liquid gas interface by numerous vertically-spaced sensors, which are a solution to the issue of improved high-pressure separation without excessive treatments. Prior art does not address the issue of minimizing the floating structure draft beyond normal ballasting for fabrication yard and tow conditions to site provided by the SSP. The SSP may therefore be fabricated and/or outfitted at common shipyards. Once lowered, the separators and associated equipment increase the draft beyond normal port access and while doing so, improves the floating vessel stability by lowering the center of gravity and increasing roll and heave-added mass and damping.

The manner of achieving improved hydrodynamic motion improvements within the present invention involves the incorporation of the following features:

1. Use of the vertical reactions of the mooring system and the steel catenary and other risers to achieve an operating draft for the facility which is sufficient for reduced motions with minimal conventional ballast;
2. providing a hull water plane area vs. draft ratio which, when tuned to the heave-added mass and damping, provides sufficient free board in design storms and provides adequate vertical heave damping to resist high-frequency response to normal wind and waves;

3. making use of the difference of the vertical wave particle velocities at the surface and at the base of the center assembly to damp out the storm-induced heave motions;
4. use of the retractable center section weight and its content in the full lowered position to decrease the overall system center of gravity;
5. use of the center section in its lowered position to improve the lateral damping in order to offset lateral motion of the primary hull section and minimize roll and sway motions;
6. use of the trapped hydrodynamic added mass due to the center assembly and its contents as well as enhanced damping and added mass features of spaced segments and the lower center section 'skirts';
7. use of the skirt extending around the lower circumference of the main hull to decrease the floating roll response by added mass and damping;
8. use of vertical gussets supporting the hull 'skirt' as fins to provide added mass and damping and to reduce yaw rotational motions.
9. providing the opportunity to separately tune roll and heave response frequencies by designing the hull skirt to control roll damping and the hull plus center section hull skirts to control heave added mass and damping, thereby allowing the system to be finely tuned for a drier deck in a design limit sea state.

BRIEF DESCRIPTION OF THE DRAWINGS

For further understanding of the nature and objects of the present invention, reference should be had to the following drawings in which like parts are given like reference numerals and wherein:

FIG. 5.1A is a side view, partly in phantom line, of a separator of the preferred embodiment of the present invention;

FIG. 5.2 is an enlarged side view of the bottom of the separator of FIG. 5.1A;

FIG. 5.3 is an enlarged view of the center of the separator of FIG. 5.1A;

FIG. 5.4 is a side view of the top of the separator of FIG. 5.1A; and

FIG. 5.5 is a plan view of the separator of FIG. 5.1A.

FIG. 5.6 is a side view of the upturned edges of the damping skirt;

FIG. 5.7 is a side view of the downturned edges of the damping skirt.

DETAILED DESCRIPTION OF THE PREFERRED EMBODIMENTS

Figure 1:
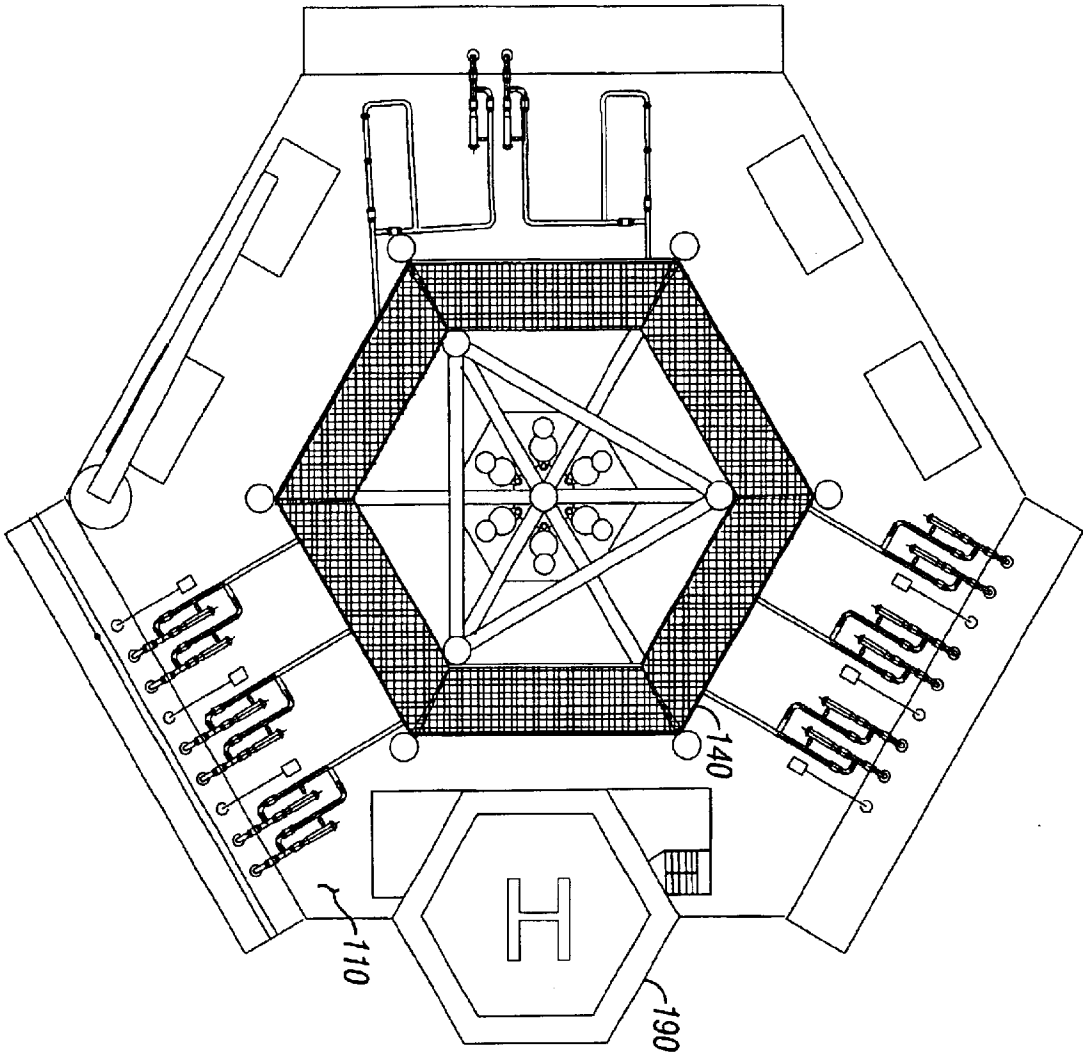
FIG. 1 presents the plan and elevation view of the preferred embodiment of the present invention.
Figure 1:
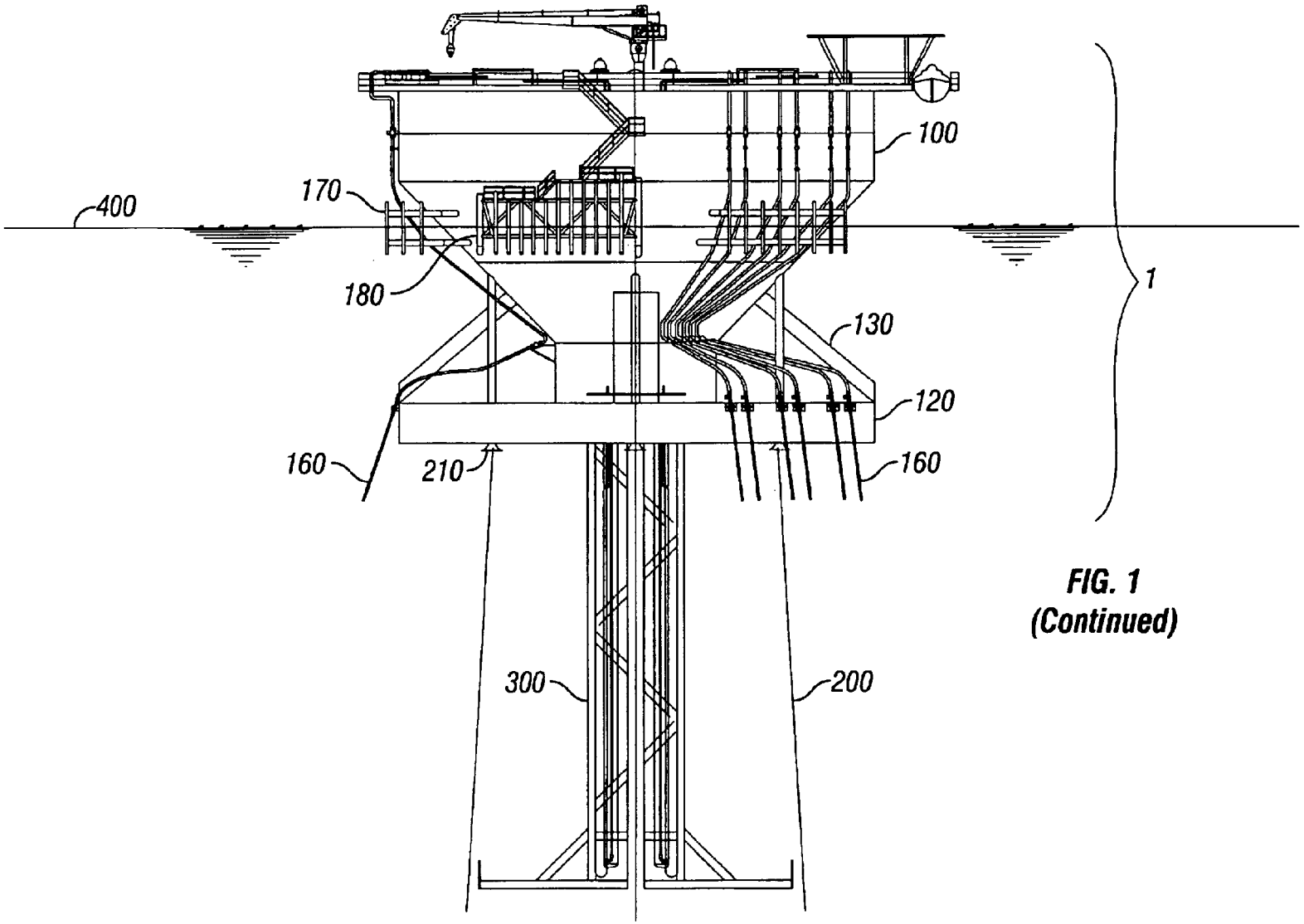

The embodiments of the present invention provide for an offshore floating structure (as shown in FIG. 1) with augmented added mass damping and mooring tensioning features which provides a moored platform for the functions of primary process oil/gas/water separation, pigging of well flowlines and downstream pipelines, chemical injection and control of satellite well functions, pressure control for outgoing gas and oil lines to the host(s), and communication links to other locations. Other features associated with the object of the invention includes a floating hull I with low draft for convenience of domestic construction, suitably broad beam for a stable tow, deep set ballast tanks to augment the tow to site, elimination for the need of deck installation offshore, and the capability of lowering the center assembly with features for improved motion. A portion of hull 1 is the hull segment 100 that is above the water line 400. Hull segment 100 includes a top deck 110, having a helideck 120 to allow helicopter traffic. Top deck 110 further includes a crane 112 for allowing materials to be transported to and from the deck 110 and cargo boats (not shown). A plurality of piping and pigging elements 113, 114 which connect the process elements in the central section 300 to the attached wells on the seabed are also located on top deck 110. A control umbilical and/or power cable 115 is also routed to the attached wells on the seabed from deck 110. Piping and pigging elements 116, 117 are also provided on deck 110 to transfer liquids and gases away from the SSP to distant pipeline or platform connections.

A second portion of hull 1 below water line 400 includes a hull skirt 120. Elements 121, 122, 123 act as a stiffener 130 which also provides rotational damping.

Hull 1 has a central section 140 which is hollow and contains a retractable section 300. The hull 1 further includes radial mooring lines 200 depending from the hull 1. Catenary risers 160 are attached to the hull skirt 120. A riser guard 170 is provided for the risers 160 as they are routed from the hull skirt 120 to the top deck II 0. Hull I also has a boat bumper 180 for allowing small vessels (not shown) to berth during loading and unloading of equipment or personnel.

The naval architectural and marine engineering aspects of the SSP floating platform differ from prior art in that reliance of the upper hull 100 of the floating structure 1 is augmented by the center assembly 300, which provides a dual service by providing a large space for various payloads and/or equipment and providing a lower center of gravity when in a lowered position to add to the stability as discussed above. Mooring attachment port 210 penetrates the upper hull 100 and acts as a restraint, thus allowing tensioning of the mooring system lines 200. The mooring system follows prior art in the use of a compound or alternate mooring system to minimize vertical reactions while providing lateral restoring force for station keeping.

Figure 2:
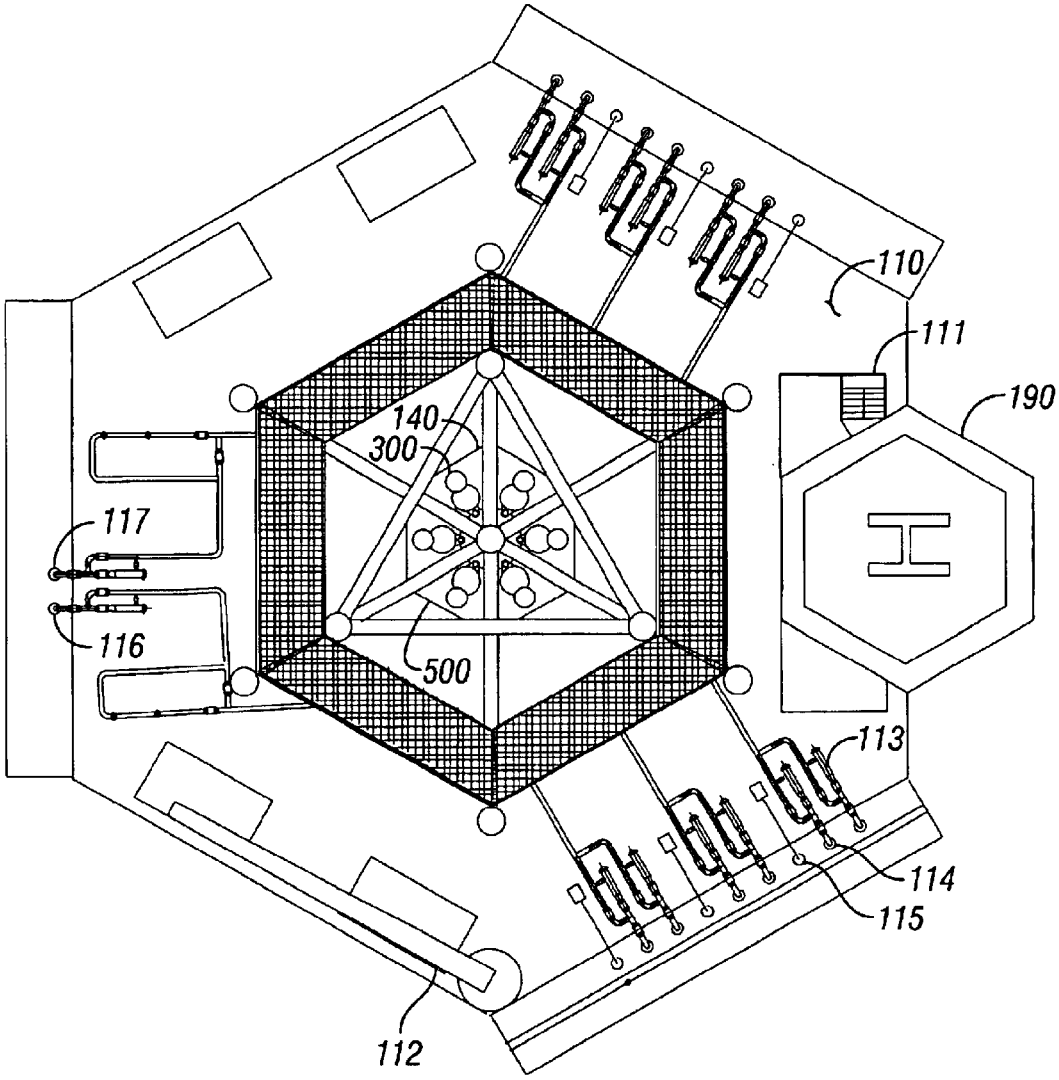
FIG. 2 presents a more detailed plan view of the deck 120.

FIG. 2 presents a more detailed plan view of the deck 120.

Figure 3A:
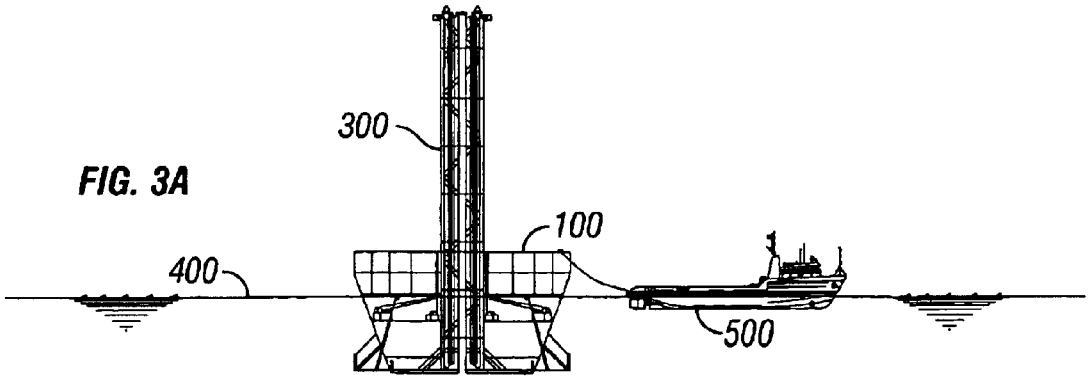
FIG. 3*a* presents the SSP with the retractable section item 300 extended for shallow water being towed by a boat 500 in an un-powered SSP configuration for transferred to/from a site.

FIG. 3*a* presents the SSP with the retractable section item 300 extended for shallow water being towed by a boat 500 in an un-powered SSP configuration for transferred to/from a site.

Figure 3B:
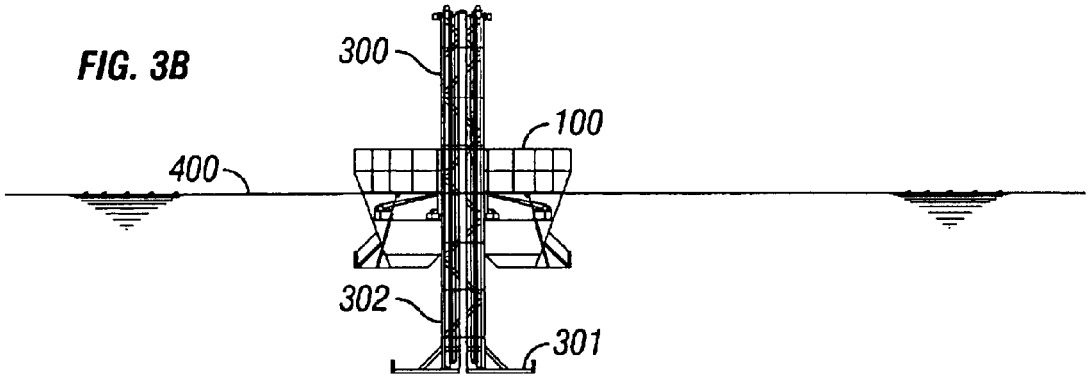
FIG. 3*b* presents the SSP in a partially ballasted position as the retractable center assembly 300 is partially lowered as may be the case of a tow during heavy seas or unexpected storm.
Figure 3C:
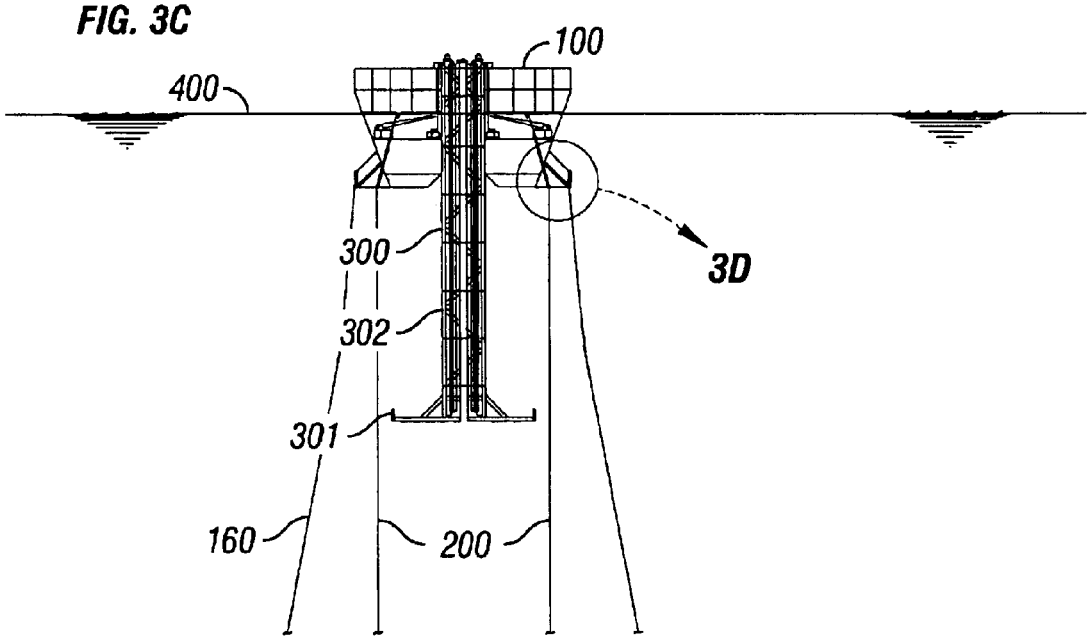
FIG. 3*c* presents the SSP in an installed position with center section 300 fully deployed below the waterline 400 and mooring lines 200 and risers 160 extending to the seabed (not shown)

FIG. 3*b* presents the SSP in a partially ballasted position as the retractable center assembly 300 is partially lowered as may be the case of a tow during heavy seas or unexpected storm;

FIG. 3*c* presents the SSP in an installed position with center section 300 fully deployed below the waterline 400 and mooring lines 200 and risers 160 extending to the seabed (not shown).

Figure 4:
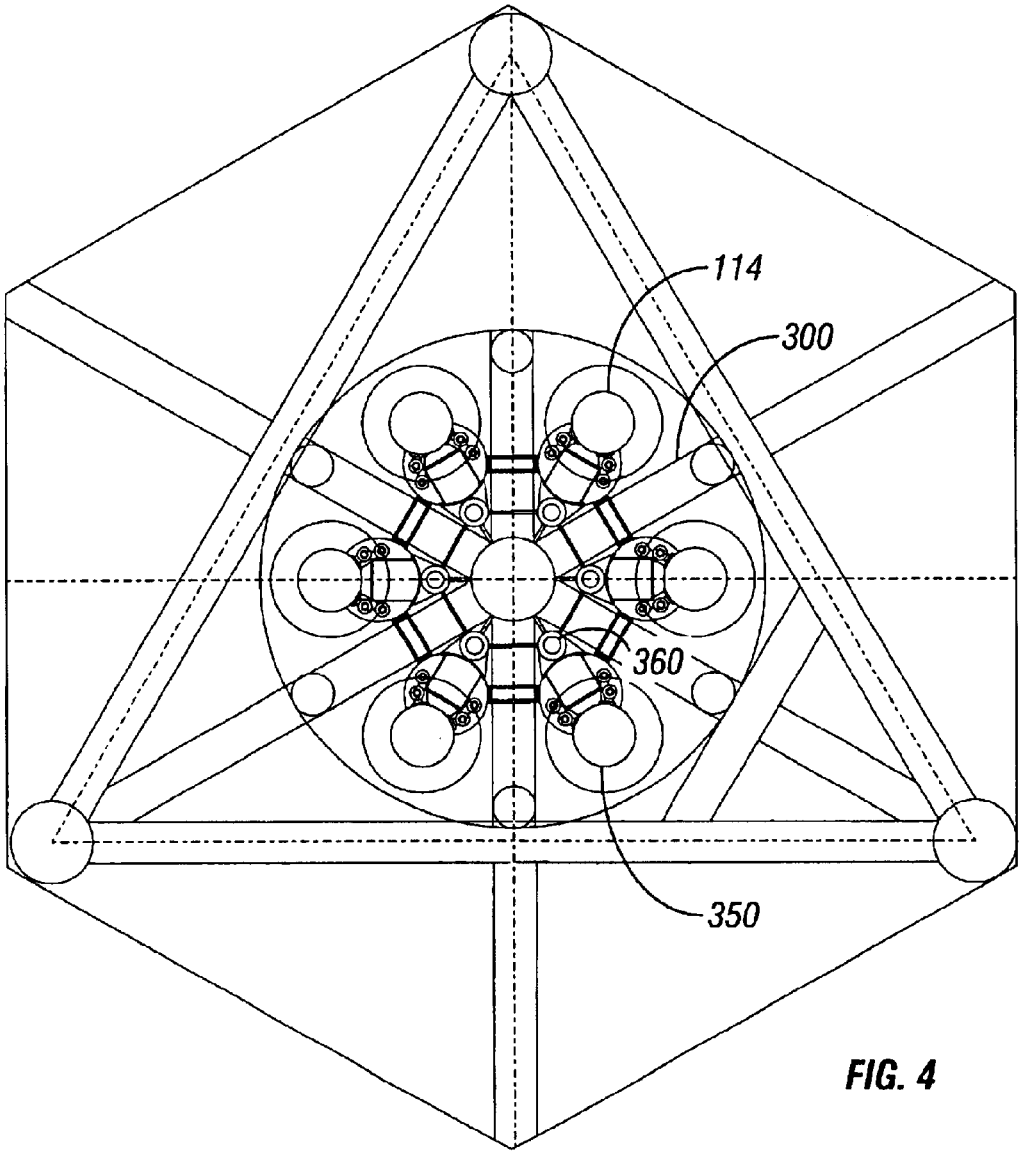
FIG. 4 is a plan view of the lowest portion separators 350 contained within the center assembly 300.

FIG. 4 shows a preferred embodiment of the separators 350 included within the center assembly 300. Separators 350 may be much larger in volume and retention time, due to their length, compared to prior art. Further, separators 350 can make up a more significant portion of the platform mass than the prior art, and provide extended retention duration for improved separation at higher pressures for separation of gas and liquids. The extended vertical length of separators extends below the water line 400, and one such separator may be provided for each well. The separators may be provided with a multitude of sensors 360 (as shown in FIG. 5), which detect the state of the fluids at each elevation and that each separator may be equipped with several outlets for gas 395, oil/condensate and water 380. Each separator 350 may be equipped with several inlet valves 390 for optimization of the incoming well stream, and the overall control system (now shown) can determine the required opening and closing of the respective valving with the object of optimizing the separation process with the available constraints of inflow and retention volume of the separators.

The economy of the design is enhanced by the fact that, if desired, limited equipment is necessary on the top deck of the facility 110, as shown in FIG. 2, with the exception of the well control panels, emergency quarters 111, and helideck 190. The well flowline and outgoing gas, oil lines, pig launcher 116 (as shown in FIG. 2), associated manifolding, and chemical injection system are on the hull segment 100, which has an optional moon pool 500. The hull segment 100 also contains the normal offshore elements of boat landings 180 and safety devices typical of floating structures.

Preferred embodiments of the process function are:

1. to allow primary well separation by long efficient vertical separators within the center assembly that may comprise a far more significant portion of the weight system than prior art, assisting the marine vessel stability;
2. to utilize vertical separators to minimize the variation of liquid surface variations relative to level settings and minimize the overall dynamic motion problems due to floating marine vessel motions;
3. to provide individual separators for continual well monitoring of gas and liquid well production and satisfy the test separation requirements for any well;
4. to allow signal transfer simultaneously of multiple individual wells with the liquid and gas rates plus temperature and pressure allowing remote control capability to a host location by satellite communication;
5. to provide improved quality gas and oil/condensate pipelines at reduced energy consumption to the shallow water host platform(s) by improved moderate to high pressure primary separation reducing pumping and compression and minimizing multi-phase conditions;
6. to provide smaller diameter pipeline from the SSP to the host platforms due to water removal nearer the subsea well field and improving flow characteristics by minimizing multiphase flow and slugging and reducing the viscosity increase associates with oil and water flow.

Figure 3D:
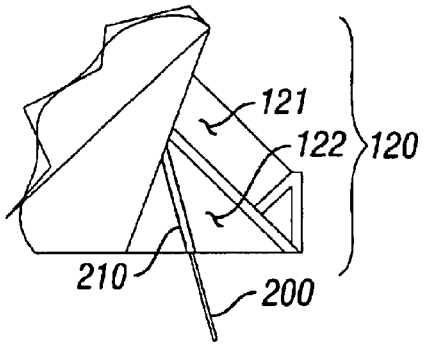

Preferred embodiments of the marine engineering aspects are:

As shown in FIG. 3*d*., an embodiment to enhance the hydrodynamic damping of the system is a hull, skirt 120, which extends below the boat level draft around the circumference of the hull and also acts to provide reinforcement for the mooring attachment points and ease of attachment of steel catenary and umbilical risers 160 while offshore. The skirt 120 is modified at the outer rim 123 to increase the added mass and damping in roll. The skirt is stiffened by large gussets 121, 122, which provide yaw damping and "pockets" for added roll mass. Such duplicity of features tends to reduce the needs for excess weight and increased fabrication costs.

The lowest portion of the separator 350 shown on FIG. 4 is contained within the center assembly 300. The center assembly 300 incorporates a damping skirt 301 (as shown in FIG. 3*c*) which, being well below the wave action of the surface, provides heave-damping and added mass and transmits the reaction to the hull via the center assembly. Other skirts 302 not previously identified, serving as reinforcements and guides for the center assembly, add to the damping and added mass in heave.

Thus, the SSP contains physical design features which facilitate: fabrication; transfer to the final site; field mounting of elements which are to be suspended from the platform to the seabed during offshore construction; mounting of specialized equipment in manners to minimize contamination from marine environments; improvement of offshore gas/oil processing field development costs; mooring in the field; and underwater video inspection of the suspended components and mooring attachments while in operation on site.

The floating facility allows the use of naval architectural features which improve the hydrodynamic motion characteristics while allowing the overall weight of the structure to be reduced for fabrication economics.

When used in the role of a moored oil/gas satellite separator platform the center assembly is used to contain hydrocarbon gas/oil separators, utility storage, and ballast. Due to the available space, separators can be measurably larger in their capacity with resulting higher retention times for improved separation of gas and liquids than normally achievable in the present offshore practice which provides much value and operational flexibility for offshore operators. Due to the large allowable vertical dimension in the center assembly, vertical separators may be implemented which are less affected by marine motions and, with the benefits of larger allowable size, offset any inefficiencies of the reduced liquid-gas contact area within the separator. Due to the space within the center assembly, a large number of vertical separators may be installed permitting individual wells to be continually monitored for their independent properties. Continual well monitoring greatly benefits the evaluation of the field production conditions by reservoir engineers. In other applications, vessels within the center assembly may provide opportunity for temporary bulk or liquid storage.

The central assembly , when fully raised, allows for the fabrication and outfitting of the SSP at numerous coastal shallow water fabrication facilities providing cost and transportation savings opportunities to nearby offshore fields. When the central assembly is fully lowered to its operational position, the center assembly enhances the motion characteristics of the floating facility by several means.

The main hull of the SSP includes hydrodynamic features such as a hull damping skirt for improved roll damping and increased roll added mass; radial plate hull damping skirt stiffeners acting as fins which provide yaw damping and increased yaw added mass; and a variable water plane area to provide nonlinear heave stiffness. These features provide benefit in storm conditions. Other features include options for a clear deck to reduce wind force and moments, locating heavy mooring and other equipment well below the top deck, and a bilge/ballast area at the hull base which all add to improve shallow water towing stability when the center assembly would be elevated for seabed clearance.

To provide benefit in storm conditions, the center assembly, in its fully lowered position, extends well below the normal water level of the floating facility providing significant improvement in the center of gravity and metacentric height; and the reduction of tall vertical separators above the hull deck further reduces wind loads and moments on the structure. The center assembly may contain vessels provided strictly for ballast or by their operations, contain production liquids that provide natural ballast. The center assembly, when lowered, provides lateral area for damping and volume for added mass for roll resistance, The damping and added mass of the center assembly differs in yaw and heave motion. The center assembly contains skirts and fins oriented to provide the degree of hydrodynamic characteristics in either of the motions and be used to tune the final system response following the hull design. The use of the center assembly to tune response in conjunction with the hull form and hull damping skirt and fins is central to this invention.

Thus, the floating platform termed an 'SSP' that may be moored or self-propelled which may be used as an offshore facility for communications and/or power generation or utility platform or work platform or to gather seabed products from outlying sources and contains a means to individually "tune" the heave added mass and damping motions separately from motions of roll and yaw.

Further, the floating platform utilizes a centrally located assembly that can be raised and lowered or installed offshore to the base of the hull, having sufficient size and volume to favorably affect the sea-keeping motions in wind and wave conditions by shifting the center of gravity and providing added mass and damping to reduce the floating structure motions in waves and wind.

Such a floating platform may utilize high pressure vertical separators providing individual well monitoring that may extend significantly below the normal water line and which may be retractable for shallow water access, or maintenance.

Such a floating platform may utilize a damping skirt at the base of the structure, which doubles as structural reinforcement for a retractable center assembly. It may also utilize a damping skirt at the base of the structure, containing upturned and/or downturned edge appurtenances, yielding pockets to improve added mass and damping characteristics.

Such a floating platform has provision for steel catenary riser (SCR) receptacles and connections which attach to the damping skirt at the base of the structure.

Such a floating platform incorporates a skirt continuous or segmented, extending laterally from the hull base to improve riser, umbilical, and cable installation ease by providing sufficient hull clearance for installation vessels and clearance for the installation rigging.

Such a floating platform utilizes mooring lines which extend from the interior dry space above the water line through vertical or near vertical hull supporting columns to vertically/or near vertically mounted fairleads.

Such a floating platform provides a central moon pool 500, shown in FIG. 2, for ROV and diver operations, which doubles as a structural stiffening of a centralized raising and lowering assembly.

Such a floating platform utilizes a series of sensors 502 and 504, shown in FIG. 5.1A in submerged or in one atmospheric environment impervious to submerged service, to identify the phase and product at various levels within separators providing information for the optimization of the system operations for valving gas, oil or condensate, or water while avoiding excess separator height.

Such a floating platform with a retractable center assembly utilizes vertical rotational symmetry to avoid the need to weathervane and reducing its overall mass requirements for accepting motions by implementing rotationally symmetric added mass and damping appurtenances.

FIG. 5.6 shows the damping skirt 310 with upturned edges 600. FIG. 5.7 shows the damping skirt 310 with downturned edges 602.

The best mode and preferred embodiments of the invention have been described. It is to be understood that the invention is not limited, thereto, but rather is to be measured by the scope and spirit of appended claims.

What is claimed is:

1. A floating structure for use in water floating above a seabed, comprising:

a. a floating hull, said hull having a beam;

b. said hull including ballast tanks;

c. said ballast tanks being set within the hull;

d. said hull having a hollow center;

e. an one piece retractable and extendable rigid center assembly adapted to move vertically above the hull and below the hull mounted in said hollow center further comprising a damping skirt at the lowest portion of the center assembly and above the sea bed.

2. The structure of claim 1, wherein said center section includes at least one vertical separator extending below the water.

3. The structure of claim 2, wherein each separator includes a separator sensor system with respect to the material located in said separator.

4. The structure of claim 1, wherein there is further included a hull skirt which extends below the water around the circumference of said hull.

5. The structure of claim 4 wherein said skirt is strengthened by gussets.

6. The structure of claim 5, wherein said stiffeners include gussets.

7. The structure of claim 1, wherein said damping skirt is located at the bottom of said center section.

8. The structure of claim 7, wherein said damping skirt has upturned edge appurtenances.

9. The structure of claim 7, wherein said damping skirt has downturned edge appurtenances.

10. The structure of claim 9, wherein said vertical members include bracing.

11. The structure of claim 1, having a damping skirt, adapted to support catenary risers.

12. The structure of claim 1, wherein said center section is set in extension and fixed in place in the water.

13. The structure of claim 1, wherein said floating hull includes means for maintaining buoyancy at a high level.

14. The structure of claim 1, wherein said center section is extendable into the water by attachment of a portion of said center section to said center section.

15. The structure of claim 1, wherein said hull has a hollow center, said center section mounted in said hollow center.

16. The structure of claim 15, wherein said center section extends through the opening of said hollow center.

17. The structure of claim 1, wherein said center section has a lower portion which includes ballast.

18. A floating structure for use in water floating above a seabed, the floating structure having a floating hull with ballast/storage tanks set within, the floating structure being characterized by:

a. the hull defining a hollow central section;

b. a center assembly mounted in said hollow central section and being retractable and extendable below the hull, and c. a fixed ballast damping skirt affixed proximate a lower portion of the center assembly to provide heave damping and added mass for the center assembly.

19. The floating structure of claim 18 further comprising a hull skirt extending about the circumference of the hull to be disposed below the water during flotation, the hull skirt providing an anchorage for the attachment of catenary risers.

20. The floating structure of claim 19, wherein said hull skirt has an outer rim portion of added mass to increase stability of the floating structure.

21. The floating structure of claim 19, wherein said hull skirt is strengthened by gussets to provide yaw damping and pockets for added roll mass.

22. The floating structure of claim 19, wherein said center assembly includes at least one vertically-oriented hydrocarbon gas/oil separator extending below the water.

23. The floating structure of claim 19, wherein the hull further includes a hull segment that is disposed above the water during floating, the hull segment further including a top deck.

* * * * *